US007144440B2

(12) United States Patent
Ando

(10) Patent No.: US 7,144,440 B2
(45) Date of Patent: Dec. 5, 2006

(54) HARD PARTICLE, WEAR-RESISTANT IRON-BASE SINTERED ALLOY, METHOD OF MANUFACTURING THE SAME, AND A VALVE SEAT

(75) Inventor: Kimihiko Ando, Toyota (JP)

(73) Assignee: Toyota Jidosha Kabushiki Kaisha, Aichi (JP)

( * ) Notice: Subject to any disclaimer, the term of this patent is extended or adjusted under 35 U.S.C. 154(b) by 82 days.

(21) Appl. No.: 10/700,591

(22) Filed: Nov. 5, 2003

(65) Prior Publication Data

US 2004/0103753 A1 Jun. 3, 2004

(30) Foreign Application Priority Data

Nov. 6, 2002 (JP) ..... 2002-322869

(51) Int. Cl.
*B22F 1/00* (2006.01)
*B22F 3/12* (2006.01)

(52) U.S. Cl. ..... 75/255; 75/246; 419/38

(58) Field of Classification Search ..... 75/246, 75/255; 419/38, 1
See application file for complete search history.

(56) References Cited

U.S. PATENT DOCUMENTS

| | | | | |
|---|---|---|---|---|
| 3,410,732 | A * | 11/1968 | Smith | 148/425 |
| 4,844,738 | A | 7/1989 | Tanase et al. | 75/241 |
| 5,529,602 | A * | 6/1996 | Ishii et al. | 75/231 |
| 5,759,227 | A * | 6/1998 | Takahashi et al. | 75/246 |
| 6,082,317 | A * | 7/2000 | Takahashi et al. | 123/188.8 |
| 6,248,292 | B1 | 6/2001 | Ando et al. | 420/585 |
| 6,613,120 | B1 | 9/2003 | Ando | |

FOREIGN PATENT DOCUMENTS

| | | |
|---|---|---|
| EP | 1 108 800 A2 | 6/2001 |
| JP | 6-92627 | 11/1994 |
| JP | 09-242516 | 9/1997 |
| JP | 2763826 | 3/1998 |
| JP | 2001-181807 | 7/2001 |

OTHER PUBLICATIONS

European Search Report dated Dec. 10, 2003.

* cited by examiner

*Primary Examiner*—Ngoclan T. Mai
(74) *Attorney, Agent, or Firm*—Finnegan, Henderson, Farabow, Garrett & Dunner LLP

(57) ABSTRACT

A hard particle having improved adhesion to a base material, a wear-resistant iron-base sintered alloy, a method of manufacturing the same, and a valve seat are provided. The hard particle comprises 20% to 70% Mo by mass, 0.2% to 3% C by mass, 1% to 15% Mn by mass, with the remainder being unavoidable impurities and Co. The sintered alloy comprises, as a whole, 4% to 35% Mo by mass, 0.2% to 3% C by mass, 0.5% to 8% Mn by mass, 3% to 40% Co by mass, with the remainder being unavoidable impurities and Fe. The alloy comprises a base material component comprising 0.2% to 5% C by mass, 0.1% to 10% Mn by mass, with the remainder being unavoidable impurities and Fe. The alloy further comprises a hard particle component comprising 20% to 70% Mo by mass, 0.2% to 3% C by mass, 1% to 15% Mn by mass, with the remainder being unavoidable impurities and Co. The hard particles are dispersed in the base material in an areal ratio of 10% to 60 %.

6 Claims, 2 Drawing Sheets

HARD PARTICLE, WEAR-RESISTANT IRON-BASE SINTERED ALLOY, METHOD OF MANUFACTURING THE SAME, AND A VALVE SEAT

BACKGROUND OF THE INVENTION

1. Technical Field

The present invention relates to a hard particle, a wear-resistant iron-base sintered alloy, and a method of manufacturing the same. Further, the invention relates to a valve seat formed by the sintered alloy, which can be suitably used in gas engines employing gases such as, in particular, CNG (compressed natural gas) or LPG (liquefied petroleum gas).

2. Background Art

JP Patent Publication (Kokai) No. 9-242516 (Patent Document 1) discloses a wear-resistant sintered alloy used in valve seats. The alloy is manufactured by compacting a powder comprising a base material component and cobalt-base hard particles. The base material component comprises 0.5% to 1.5% C by weight, 2.0% to 20.0% at least one element selected from the group consisting of Ni, Co and Mo by weight, with the remainder being Fe, against 100% of the powder. The cobalt-base hard particles comprise 26% to 50% by weight of the powder. The green compact is molded and then sintered at high temperatures to form the wear-resistant sintered alloy. In this example, the cobalt-base hard particles are made of an intermetallic compound with Vicker's hardness (Hv) of 500 or more, containing Co as the principal component and heat-resistant, corrosion-resistant elements (such as Mo, Cr and Ni). In this sintered alloy, the oxide layer formation on the hard particles and the base material is insufficient. As a result, adhesion tends to occur due to the relative sliding movements of the metals. Further, there is not much dispersion between the hard particles and the base material during sintering, resulting in insufficient joint strength, so that the hard particles tend to fall away. The alloy, therefore, does not have a sufficient wear resistance.

JP Patent Publication (Kokai) No. 2001-181807 (Patent Document 2) discloses a wear-resistant sintered alloy similarly used in valve seats. The alloy as a whole contains 4% to 30% Mo by mass, 0.2% to 3% C by mass, 1% to 20% Ni by mass, 0.5% to 12% Mn by mass, with the remainder being unavoidable impurities and Fe. The base material consists of 0.2% to 5% C by mass, 0.1% to 12% Mn by mass, with the remainder being unavoidable impurities and Fe. Hard particles consist of 20% to 70% Mo by mass, 0.5% to 3% C by mass, 5% to 40% Ni by mass, 1% to 20% Mn by mass, with the remainder being unavoidable impurities and Fe. The hard particles are dispersed in the base material in an areal ratio of 10% to 60%.

In this sintered alloy, the amount of dispersion of Mn contained in the hard particles into the base material of the sintered alloy is large, so that the adhesion between the hard particles and the base material can be improved. Thus, the retainability of the hard particles is improved, the density of the sintered alloy can be increased, and the hardness and wear resistance of the alloy can be increased. Further, the hard particles do not contain Cr as an active element, thus facilitating the formation of an oxide layer of Mo on the hard particles. The Mo oxide layer functions as a solid lubricant, thus providing the hard particles with lubricity, in addition to hardness and wear resistance. As a result, the alloy according to this publication proves highly effective as the material for valve seats or valve guides in CNG- or LNG-fueled engines, in which the solid lubricity in the slide range tends to be low as compared with that in the valve system of gasoline engines.

Patent Document 1: JP Patent Publication (Kokai) No. 9-242516 A (1997)

Patent Document 2: JP Patent Publication (Kokai) No. 2001-181807

In the course of experiments conducted on various materials for valve seats and valve guides to be used in engines, particularly those fueled with CNG or LNG, the inventors arrived at the conclusion that, although the wear-resistant sintered alloy disclosed in JP Patent Publication (Kokai) No. 2001-181807 has high wear resistance, a sintered alloy is needed that has higher wear resistance if higher engine performance is to be obtained. It is therefore an object of the invention to provide a hard particle, a wear-resistant iron-base sintered alloy, a method of manufacturing the wear-resistant iron-base sintered alloy, and a valve seat wherein an oxide layer of the hard particle can be easily formed and high wear resistance can be obtained.

SUMMARY OF THE INVENTION

With a view to achieving the object of the invention, the inventors conducted further research on hard particles and wear-resistant iron-base sintered alloys in which hard particles are dispersed. As a result, the inventors arrived at the realization that by using Co in the remainder of the hard particle instead of Fe, a matrix of Co can provide superior wear resistance in a sintered alloy in which the hard particle is mixed, as compared with the case where Ni and Fe are used in forming the matrix. The hard particle, the wear-resistant iron-base sintered alloy, and the method of manufacturing the same according to the invention are based on this realization.

In one aspect, the invention provides a hard particle comprising 20% to 70% Mo by mass, 0.2% to 3% C by mass, 1% to 15% Mn by mass, with the remainder being unavoidable impurities and Co.

In another aspect, the invention provides a wear-resistant iron-base sintered alloy which consists of 4% to 35% Mo by mass, 0.2% to 3% C by mass, 0.5% to 8% Mn by mass, 3% to 40% Co by mass, with the remainder being unavoidable impurities and Fe against the total of 100%. The wear-resistant iron-base sintered alloy comprises a base material component consisting of 0.2% to 5% C by mass, 0.1% to 10% Mn by mass, with the remainder being unavoidable impurities and Fe against 100% of the base material. The wear-resistant iron-base sintered alloy further comprises a hard particle component consisting of 20% to 70% Mo by mass, 0.2% to 3% C by mass, 1% to 15% Mn by mass, with the remainder being unavoidable impurities and Co against 100% of the hard particles. The hard particles are dispersed in the base material in an areal ratio of 10% to 60%.

Preferably, in the wear-resistant iron-base sintered alloy, a ratio $\alpha$ of the amount in percentage by mass of Mn in the base material of the sintered alloy to the amount in percentage by mass of Mn in the hard particles dispersed in the base material of the sintered alloy may be within a range between 0.05 and 1.0.

In a further aspect, the invention provides a method of manufacturing the wear-resistant iron-base sintered alloy. In this method, a mixed material is prepared that is 10% to 60% a powder of the hard particle by mass, 0.2% to 2% carbon powder by mass, with the remainder being a powder of pure Fe or low-alloy steel. The mixed material is molded into a powder compact molded product and then sintered.

The wear-resistant iron-base sintered alloy according to the invention may be used in a valve seat in a gas engine fueled by compressed natural gas or liquefied petroleum gas. The invention further provides a valve seat formed by the wear-resistant iron-base sintered alloy.

DESCRIPTION OF THE INVENTION

Figure 1:
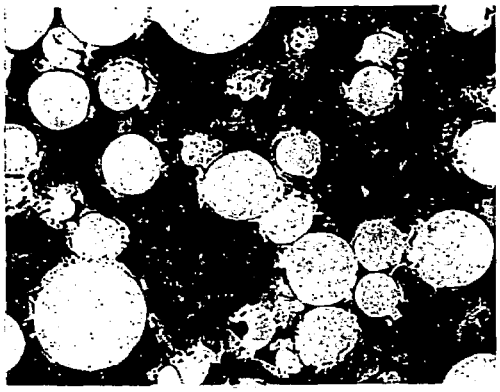
FIG. 1 is an optical microscopic photograph of an example of the wear-resistant iron-base sintered alloy according to Example 1 of the invention (magnification: ×100).

The invention will be hereafter described in detail. As described above, the invention provides a hard particle consisting of 20% to 70% Mo by mass, 0.2% to 3% C by mass, 1% to 15% Mn by mass, with the remainder being unavoidable impurities and Co. In the hard particle, Co forms a matrix. Mo combines with C to form Mo carbide, whereby the hardness and wear resistance of the hard particle can be increased. Further, Mo and Mo carbide dissolved in the matrix of Co form a coating of Mo oxide, whereby the sliding movement between metals, which causes adhesion, can be reduced and an improved solid lubrication property can be obtained. If the Mo content is less than 20%, the oxide coating cannot be formed sufficiently and the solid lubrication property in the hard particle would suffer. If the Mo content is more than 70%, moldability would decrease and so would the strength of the resultant sintered product.

C combines with Mo to form Mo carbide, whereby the hardness and wear resistance of the hard particle can be increased. If the C content is less than 0.2%, a sufficient amount of Mo carbide cannot be formed, and thus the wear resistance of the particle would be insufficient. If the C content exceeds 3%, the moldability would decrease, along with the strength of the resultant sintered product.

Mn has a low melting point and is easily diffused into the base material during sintering. Thus, in the composition of the above-described hard particle, Mn is efficiently diffused into the base material of the alloy from the hard particles during sintering, whereby the adhesion between the hard particles and the base material can be improved. Further, Mn can be expected to provide an austenite-increasing effect in the base material. If the Mn content is less than 1%, sufficient diffusion cannot be obtained, resulting in poor adhesion. If the Mn content exceeds 15%, moldability decreases and so does the strength of the resultant sintered product.

In the hard particle according to the invention, the remainder consists of unavoidable impurities and Co and it does not contain Ni or Fe as active elements. It has been confirmed that by forming a matrix with Co, a superior wear resistance can be obtained in the sintered product in which the hard particle is mixed, as compared with the case where the matrix was formed with Ni and Fe. This is conjectured to be due to the fact that Co has a small stacking fault energy such that a stacking fault is created, thus increasing the strength of the sintered product. Further, resistance to thermal fatigue can be ensured.

The hard particle according to the invention does not contain Cr as an active element. Thus, in the hard particle according to the invention, an oxide coating can be formed at relatively low temperatures, so that a significant solid lubrication property can be ensured in relatively low- to medium-temperature regions. This is believed to be due to the following reasons. The formation of an oxide coating on the surface of a hard particle is believed to be influenced by the oxidation rate and diffusion rate of the alloy elements contained in the hard particle. While Cr is easily oxidized and so it has a high oxidation rate, its diffusion rate is conjectured to be small. Further, Cr forms a dense oxide coating that can easily prevent the entry of oxygen. Thus, by eliminating the Cr content in the hard particles, the growth of the oxide film is prevented, so that the oxidation start temperature decreases. In contrast, Mo is easily oxidized and its oxidation rate as well as diffusion rate is high. Mo does not form an oxide film as dense as that formed by Cr, thus allowing the entry of oxygen more easily. As a result, Mo can easily form an oxide film with the expected solid lubrication property in a relatively low temperature region of the heated area.

The hard particle according to the invention may be manufactured either by atomizing a molten metal or by mechanically pulverizing a coagulation of a molten metal into a powder. Preferably, the atomization may be carried out in a nonoxidizing atmosphere (such as nitrogen, argon, or other inert gas, or vacuum).

The average particle size of the hard particle according to the invention may be suitably selected depending on the application and type of the iron-base sintered alloy. Generally, however, the particle size may be but not limited to 20 to 250 μm, more preferably 30 to 200 μm, and most preferably 40 to 180 μm. The hardness of the hard particle depends on the content of Mo carbide; generally, however, it may be Hv 350 to 750, and more preferably Hv 450 to 700.

The wear-resistant iron-base sintered alloy according to the invention comprises a base material component consisting of 0.2% to 5% C by mass, 0.1% to 10% Mn by mass, with the remainder being unavoidable impurities and Fe, against 100% of the base material. The base material of the sintered alloy may contain small amounts of Mo and/or Co due to their diffusion from the hard particle.

The composition of the base material of the iron-base sintered alloy is thus limited mainly in order to ensure the hardness and therefore the wear resistance of the alloy. Preferably, the base material may employ a composition containing perlite. Examples of the perlite-containing composition include a perlite composition, a perlite-austenite mixture composition, a perlite-ferrite mixture composition, and a perlite-cementite mixture composition. In order to ensure wear resistance, the content of ferrite, whose hardness is low, should preferably be small. The hardness of the base material depends on its composition; generally, it may be but not limited to Hv 120 to 300 or more preferably Hv 150 to 250. As mentioned above, the hard particle is made harder than the base material and its hardness may be but not limited to Hv 350 to 750 or more preferably Hv 450 to 700.

The Mn content of the base material of the sintered alloy according to the invention is thought to be diffused from the hard particle during sintering. When the pure Fe powder or the low-alloy steel powder forming the base material of the sintered alloy has no Mn content, a ratio α of the Mn content, in percentage by mass, in the base material of the sintered alloy to the Mn content, in percentage by mass, in the hard particles distributed in the base material varies depending on the composition of the hard particle or the proportion of the hard particles. The ratio α, however, should preferably be of the order of 0.05 to 1.0, as mentioned above. In the sintered alloy according to the invention, the hard particles are distributed in the base material in an areal ratio of 10 to 60%. If the ratio is less than 10%, sufficient wear resistance cannot be obtained, while ratios exceeding 60% result in a reduced moldability of the alloy and a reduced strength of the sintered product. In the wear-resistant iron-base sintered alloy according to the invention, the limitations concerning the composition of the hard particle and the preferable ranges of composition are adopted basically for the same reason as those for the above-described hard particle.

In accordance with the method of manufacturing wear-resistant iron-base sintered alloy according to the invention, a mixture material is prepared that consists of 10% to 60% the aforementioned hard particle powder by mass, 0.2% to 2% carbon powder by mass, with the remainder being Fe powder or low-alloy steel powder. The mixture material is molded into a powder compact molded product and then sintered to provide a sintered alloy having any of the compositions described above.

The aforementioned hard particles are distributed in the sintered alloy base material and provide a hard phase that increases the wear resistance of the sintered alloy. If the ratio of the hard particles is low, sufficient wear resistance of the sintered alloy cannot be obtained. If the ratio of the hard particles is excessive, the mating-member attacking property increases and also it becomes difficult to ensure the retention of the hard particles. Thus, the content of the hard particle powder is set to be at 10% to 60% by mass. Generally, the carbon powder may be graphite powder. The carbon (C) in the carbon powder is diffused in the base material or the hard particles in the sintered alloy, producing a solid solution or a carbide (Mo carbide or cementite, for example). Thus, the content of the carbon powder is set to be at 0.2% to 2%.

The Fe powder or the low-alloy steel powder forms the base material of the wear-resistant iron-base sintered alloy. According to the above manufacturing method, the cost of the starting materials can be reduced, and further the compression moldability of the compact powder molded product can be enhanced, so that the density of the compact powder molded product and that of the sintered alloy can be increased.

In accordance with the above manufacturing method, the alloy elements contained in either the hard particles or the base material are diffused into the other during sintering. As a result, an improved adhesion between the hard particles and the base material can be obtained. In particular, when the hard particle having the composition according to the invention is adopted, if Co is used in forming the matrix, an improved wear resistance can be obtained in the sintered material in which the hard particle is mixed, as compared with the case of using Ni and Fe in forming the matrix. Further, Mn contained in the hard particle can be efficiently diffused in the base material, so that the adhesion between the hard particle and the base material can be improved. Thus the density of the sintered alloy and the hardness of the hard particle can be increased, and the wear resistance of the sintered alloy can be improved.

The Fe powder or the low-alloy steel powder is used in forming the base material of the wear-resistant iron-base sintered alloy, as described above. Preferably, the low-alloy steel powder may be an Fe—C powder having a composition consisting of 0.2% to 5% C with the remainder being unavoidable impurities and Fe against 100% of the low-alloy steel powder. The sintering temperature may be of the order of 1050 to 1250° C., particularly 1100 to 1150° C. The sintering time may be 30 to 120 minutes, particularly 45 to 90 minutes at the above sintering temperatures. Preferably, the sintering atmosphere is nonoxidizing atmosphere such as an inert gas. Examples of the nonoxidizing atmosphere include nitrogen, argon, and vacuum.

In accordance with the manufacturing method of the wear-resistant iron-base sintered alloy according to the invention, the preferable range of the composition of the hard particle and the reason for limiting the composition of the hard particle are basically the same as those described above. The hardness of the hard particle and its average particle size are basically the same as those described above with respect to the sintered alloy.

Generally, in the valve system of a gas engine fueled by CNG or LPG, the solid lubrication in the sliding areas is poor as compared with that in the valve system of a gasoline engine. This is conjectured to be due to the fact that because of a weak oxidizing force of the combustion atmosphere as compared with that in a gasoline engine, an oxide layer with a solid lubricating property is more difficult to be formed in the gas engine. As mentioned above, in the wear-resistant iron-base sintered alloy according to the invention, Co contained in the hard particle forms a matrix, which improves the wear resistance of the sintered material as compared with the case where Ni and Fe are used in forming the matrix. Further, Mo contained in the hard particle easily produces a good oxide layer at lower temperatures than that at which Cr produces an oxide layer. Accordingly, the solid lubricating property provided by the oxide layer can be ensured at low- to medium-temperature regions of the environment in which the hard particle is used. Thus, the hard particle possesses solid lubricating property as well as it is hard. Thus, the wear-resistant iron-base sintered alloy according to the invention is suitable for use in the valve system such as the seat or valve face in gas engines for vehicles fueled by CNG or LPG. Of course, the wear-resistant iron-base sintered alloy can be used in the valve seat or valve face in gasoline or diesel engines. These applications are merely examples, and the wear-resistant iron-base sintered alloy according to the invention can also be used in sliding members employed in heated portions, such as a valve guide and a turbo wastegate valve bush.

EXAMPLES

The invention will be hereafter described by way of examples and comparative examples. In the examples, samples A to Q of alloy powders with the compositions as shown in Table 1 were manufactured by gas atomization using an inert gas (nitrogen gas). These powders were classified into ranges from 45 to 180 μm and were then used as hard particle powders.

TABLE 1

| | Composition (mass %) | | | | | | | | Oxidation start |
|---|---|---|---|---|---|---|---|---|---|
| | Mo | C | Ni | Mn | Co | Cr | Si | Fe | temp. (° C.) |
| A | 40 | 1.5 | | 6 | Remainder | | | | 610 |
| B | 25 | 1.6 | | 6 | Remainder | | | | 600 |
| C | 60 | 1.5 | | 6 | Remainder | | | | 630 |
| D | 40 | 1.5 | | 2 | Remainder | | | | 640 |
| E | 40 | 1.5 | | 12 | Remainder | | | | 560 |
| F | 40 | 0.3 | | 6 | Remainder | | | | 590 |
| G | 40 | 2.5 | | 6 | Remainder | | | | 620 |
| H | 40 | 1.5 | Remainder | 6 | | | | | 630 |
| I | 40 | 1.5 | | 6 | | | | Remainder | 590 |
| J | 14 | 1.5 | | 6 | Remainder | | | | 600 |
| K | 75 | 1.5 | | 6 | Remainder | | | | 650 |
| L | 40 | 0.05 | | 6 | Remainder | | | | 590 |
| M | 40 | 4 | | 6 | Remainder | | | | 640 |
| N | 40 | 1.5 | | | Remainder | | | | 660 |
| O | 40 | 1.5 | | 20 | Remainder | | | | 550 |
| P | 28 | 0.07 | 0.3 | | Remainder | 9.5 | 2.2 | 0.4 | 750 |
| Q | 33 | 0.8 | 10 | 6 | 30 | 5.0 | 1 | Remainder | 660 |

Samples A to G are powders corresponding to the hard particles within the range of the present invention and are the materials according to the invention. Samples H to Q are comparative examples. Sample H does not contain Co and its remainder is Ni. Sample I does not contain Co and its remainder is Fe. Sample J contains a small amount, 14%, of Mo. Sample K contains a large amount, 75%, of Mo. Sample L contains a small amount, 0.05%, of C. Sample M contains a large amount, 4%, of C. Sample N does not contain Mn. Sample O contains a large amount, 20%, of Mn. In sample P, the remainder is Co but a small amount, 0.07%, of C and also Ni, Cr, Si and Fe are contained. Sample P corresponds to the alloy disclosed in Patent Document 1. Sample Q contains Co but in which the remainder is Fe and in which Ni, Cr and Si are contained. Sample Q corresponds to the alloy disclosed in Patent Document 2.

The powders of the hard particles of samples A to Q were heated in the atmosphere to oxidize them, and the temperatures at which their weight increases sharply due to oxidization was investigated. As shown in Table 1, the hard particle powders A to G (not containing Cr) that are within the range of the present invention have lower oxidation start temperatures than the conventional hard particle powders P and Q (containing Cr).

TABLE 2

| | Hard particle mixture weight ratio (%) | | | | | | | | | | | | | | | | | Graphite mixture | Fe powder |
|---|---|---|---|---|---|---|---|---|---|---|---|---|---|---|---|---|---|---|---|
| | A | B | C | D | E | F | G | H | I | J | K | L | M | N | O | P | Q | weight ratio (%) | mixture ratio |
| Ex. 1 | 40 | | | | | | | | | | | | | | | | | 0.6 | Remainder |
| Ex. 2 | 15 | | | | | | | | | | | | | | | | | 0.6 | Remainder |
| Ex. 3 | 55 | | | | | | | | | | | | | | | | | 0.6 | Remainder |
| Ex. 4 | 40 | | | | | | | | | | | | | | | | | 0.3 | Remainder |
| Ex. 5 | 40 | | | | | | | | | | | | | | | | | 1.8 | Remainder |
| Ex. 6 | | 40 | | | | | | | | | | | | | | | | 0.6 | Remainder |
| Ex. 7 | | | 40 | | | | | | | | | | | | | | | 0.6 | Remainder |
| Ex. 8 | | | | 40 | | | | | | | | | | | | | | 0.6 | Remainder |
| Ex. 9 | | | | | 40 | | | | | | | | | | | | | 0.6 | Remainder |
| Ex. 10 | | | | | | 40 | | | | | | | | | | | | 0.6 | Remainder |
| Ex. 11 | | | | | | | 40 | | | | | | | | | | | 0.6 | Remainder |
| Comp. Ex. 1 | | | | | | | | 40 | | | | | | | | | | 0.6 | Remainder |
| Comp. Ex. 2 | | | | | | | | | 40 | | | | | | | | | 0.6 | Remainder |
| Comp. Ex. 3 | | | | | | | | | | 40 | | | | | | | | 0.6 | Remainder |
| Comp. Ex. 4 | | | | | | | | | | | 40 | | | | | | | 0.6 | Remainder |
| Comp. Ex. 5 | | | | | | | | | | | | 40 | | | | | | 0.6 | Remainder |
| Comp. Ex. 6 | | | | | | | | | | | | | 40 | | | | | 0.6 | Remainder |
| Comp. Ex. 7 | | | | | | | | | | | | | | 40 | | | | 0.6 | Remainder |
| Comp. Ex. 8 | | | | | | | | | | | | | | | 40 | | | 0.6 | Remainder |
| Comp. Ex. 9 | | | | | | | | | | | | | | | | 40 | | 0.6 | Remainder |
| Comp. Ex. 10 | | | | | | | | | | | | | | | | | 40 | 0.6 | Remainder |

The hard particle powders of samples A to Q, graphite powder and pure Fe powder were mixed in the proportions shown in Table 2 in a mixer to form mixed powders as the mixture materials for Examples 1 to 11 and Comparative Examples 1 to 10. As shown in Table 2, in most of the Examples and all of the Comparative Examples, the hard particle powder is 40% by mass and the graphite powder is 0.6% by mass. In Example 2, the proportion of hard particle powder is reduced to 15%. In Example 3, the proportion of hard particle powder is increased to 55%. In Example 4, the proportion of graphite powder is reduced to 0.3%, while in Example 5, the proportion of graphite powder is increased to 1.8%.

The mixture powders according to Examples 1 to 11 and Comparative Examples 1 to 10 are compacted into valve-seat-shaped powder compact molded products using a mold under a pressure of $78.4\times10^7$ Pa (8 tonf/cm$^2$). The individual powder compact molded products were then sintered in an inert atmosphere (nitrogen gas atmosphere) at a temperature of 1120° C. for 60 minutes, thereby obtaining test pieces made of sintered alloy (valve seats).

A test piece of sintered alloy (valve seat) was manufactured according to the conditions shown in Table 3 (Comparative Example 11). In Comparative Example 11, sample P in Table 1 was mixed in 40% by mass as the hard particle. To improve the density and wear resistance of the sintered alloy, the process of compacting the mixture powder into a compact powder molded product and sintering the product was repeated twice. The composition shown in Table 3 indicates the total composition of the sintered alloy.

TABLE 3

| | Composition (mass %) | | | | | | | Mixed hard | Hard particle mixture weight | |
|---|---|---|---|---|---|---|---|---|---|---|
| | Mo | C | Ni | Co | Cr | Si | Fe | particle | ratio (%) | Remarks |
| Comp. Ex. 11 | 11.5 | 1 | 6 | 24 | 5 | 1 | Remainder | P | 40 | Compacting and Sintering were repeated twice |

FIG. 1 shows an optical microscopic photograph of the alloy according to Example 1 (magnification ×100). As shown, many dark and spherical hard particles are dispersed in the base material of the sintered alloy like islands scattered in the ocean. Hardly any air holes were recognized. In FIG. 1, the proportion of the hard particles was 20% to 50% in area against 100% of the sintered alloy (base material+hard particles). In FIG. 1, the ocean-like dark portions in the base material are conjectured to be perlite, while the white portions around the hard particles in the base material are conjectured to be austenite.

Figure 3:
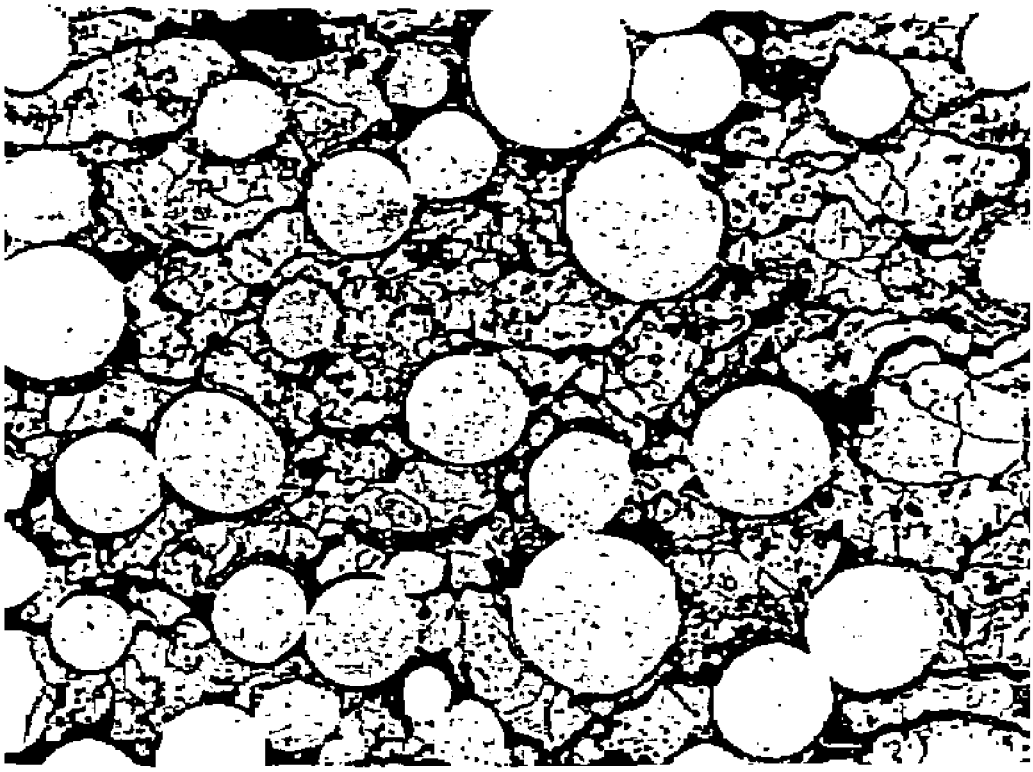
FIG. 3 is an optical microscopic photograph of a conventional example of the wear-resistant iron-base sintered alloy (corresponding to Comparative Example 9; magnification: ×100).

FIG. 3 shows an optical microscopic photograph of Comparative Example 9 (Sample P; magnification ×100). In the sintered alloy of Comparative Example 9, many spherical, white hard particles are dispersed in the base material of the sintered alloy. A considerable number of air holes (dark portions between the hard particles) can be recognized between the hard particles.

In order to determine the joint condition between the hard particles and the base material in each sintered alloy, the total composition the alloy, the composition of the hard particles, and the composition of the base material were measured by EPMA analysis for each test piece. The result of the analysis are shown in Table 4, in which the total composition is the composition against 100% by mass of the sintered alloy. The hard particle composition is the composition against 100% by mass of the hard particles. The base material composition is the composition against 100% by mass of the base material.

TABLE 4

| | | mass (%) | | | | |
|---|---|---|---|---|---|---|
| | | Mo | C | Mn | Co | Fe |
| Ex. 1 | Total composition | 16 | 1.2 | 2.4 | 21 | 59.4 |
| | Matrix composition | 1 | 1.1 | 1.3 | 1 | 95.6 |
| | Hard particle composition | 38.5 | 1.4 | 4 | 51 | 5.1 |
| Ex. 6 | Total composition | 10 | 1.2 | 2.4 | 27 | 59.4 |
| | Matrix composition | 0.67 | 1.1 | 1.4 | 1.7 | 95.13 |
| | Hard particle composition | 24 | 1.4 | 3.9 | 65 | 5.7 |
| Ex. 7 | Total composition | 24 | 1.2 | 2.4 | 13 | 59.4 |
| | Matrix composition | 1.3 | 1 | 1.3 | 1 | 95.4 |
| | Hard particle composition | 58 | 1.5 | 4.1 | 31 | 5.4 |

TABLE 4-continued

| | | mass (%) | | | | |
|---|---|---|---|---|---|---|
| | | Mo | C | Mn | Co | Fe |
| Ex. 8 | Total composition | 16 | 1.2 | 0.8 | 22.6 | 59.4 |
| | Matrix composition | 1 | 1.1 | 0.3 | 1 | 96.6 |
| | Hard particle composition | 38.5 | 1.4 | 1.5 | 55 | 3.6 |
| Ex. 9 | Total composition | 16 | 1.2 | 4.8 | 18.6 | 59.4 |
| | Matrix composition | 1 | 1.1 | 2.7 | 1 | 94.2 |
| | Hard particle composition | 38.5 | 1.4 | 8 | 45 | 7.1 |
| Ex. 10 | Total composition | 16 | 0.7 | 2.4 | 21.5 | 59.4 |
| | Matrix composition | 1 | 0.8 | 1.3 | 1.2 | 95.7 |
| | Hard particle composition | 38.5 | 0.5 | 4 | 52 | 5 |

TABLE 4-continued

| | | mass (%) | | | | |
|---|---|---|---|---|---|---|
| | | Mo | C | Mn | Co | Fe |
| Ex. 11 | Total composition | 16 | 1.6 | 2.4 | 20.6 | 59.4 |
| | Matrix composition | 1 | 1.3 | 1.3 | 1 | 95.4 |
| | Hard particle composition | 38.5 | 2 | 4 | 50 | 5.5 |
| Comp. Ex. 7 | Total composition | 16 | 1.2 | | 23.4 | 59.4 |
| | Matrix composition | 1 | 1.1 | | 1 | 96.9 |
| | Hard particle composition | 38.5 | 1.4 | | 57 | 3.1 |

According to the examples, Mn, Mo and Co are contained in the base material of each sintered alloy, as shown in Table 4, even though Mn, Mo and Co are not contained in the Fe powder used as the starting material of the base material of the sintered alloys. This is conjectured to be the result of the Mn, Mo and Co in the hard particles having thermally diffused during sintering. As shown in Table 4, the amount of Mn contained in the base material exceeds 1% in most of the examples and is quite large. It is believed that Mn contained in the hard particles is easily diffused into the base material of the sintered alloy during sintering.

Specifically, despite the fact that Mn was not contained in the Fe powder as the starting material of the base material, quite large amounts of Mn were contained in the base material of the sintered alloys. More specifically, the amounts of Mn contained in the base material were 1.3% in Example 1, 1.4% in Example 6, 1.3% in Example 7, 2.7% in Example 9, 1.3% in Example 10, and 1.3% in Example 11. In Example 8, as the amount of Mn contained in the hard particles was small (about 37% that of Examples 1 to 4, or 15/40), the Mn content was 0.3%.

When the mass % ratio of the amount of Mn in the base material of the sintered alloy to that in the hard particles dispersed in the base material is $\alpha$, the value of $\alpha$ was:

In Example 1: 1.3/4.0=0.235
In Example 6: 1.4/3.9=0.359
In Example 7: 1.3/4.1=0.317
In Example 8: 0.3/1.5=0.200
In Example 9: 2.7/8.0=0.338
In Example 10: 1.3/4.0=0.325
In Example 11: 1.3/4.0=0.325

Thus, $\alpha$ was within the range between about 0.10 and 0.7, particularly between 0.15 and 0.45, thus indicating the high dispersion efficiency of Mn.

As for the dispersion of Mo, when the ratio of the amount of Mo contained in the base material to that contained in the hard particles is $\beta$, the value of $\beta$ was:

In Example 1: 1.00/38.5=0.030
In Example 6: 0.67/24.0=0.030
In Example 7: 1.30/58.0=0.022
In Example 8: 1.00/38.5=0.026
In Example 9: 1.00/38.5=0.026
In Example 10: 1.00/38.5=0.026
In Example 11: 1.00/38.5=0.026

Thus, the value of $\beta$ indicating the dispersion efficiency of Mo was within the range between 0.02 and 0.03, which is smaller than the Mn dispersion efficiency $\alpha$ by an order of magnitude. This shows how high the dispersion efficiency of Mn is.

As to the diffusion of Co, when the ratio of Co contained in the base material to that contained in the hard particles is $\theta$, the value of $\theta$ was:

In Example 1, 1.00/51.0=0.016
In Example 6, 1.70/65.0=0.026
In Example 7, 1.00/31.0=0.032
In Example 8, 1.00/55.0=0.018
In Example 9, 1.00/45.0=0.022
In Example 10, 1.20/52.0=0.023
In Example 11, 1.00/50.0=0.020

Thus, the value of $\theta$ indicating the diffusion efficiency of Co was within the range between 0.01 and 0.04, which is smaller than the Mn diffusion efficiency $\alpha$ by an order of magnitude.

Further, in order to confirm the above-described matters, the density of each test piece was measured. The measurement results are shown in Table 5.

TABLE 5

| | Density of sintered product (g/cm$^3$) | Valve projection amount (μm) | Increase in seat contact width (mm) |
|---|---|---|---|
| Ex. 1 | 7.35 | 4 | 0.01 |
| Ex. 2 | 7.2 | 15 | 0.025 |
| Ex. 3 | 7.28 | 10 | 0.02 |
| Ex. 4 | 7.38 | 20 | 0.05 |
| Ex. 5 | 7.25 | 15 | 0.03 |
| Ex. 6 | 7.3 | 10 | 0.02 |
| Ex. 7 | 7.37 | 5 | 0.015 |
| Ex. 8 | 7.3 | 15 | 0.03 |
| Ex. 9 | 7.32 | 12 | 0.025 |
| Ex. 10 | 7.35 | 15 | 0.03 |
| Ex. 11 | 7.25 | 20 | 0.04 |
| Comp. Ex. 1 | 7.25 | 100 | 0.3 |
| Comp. Ex. 2 | 7.15 | 60 | 0.2 |
| Comp. Ex. 3 | 7.25 | 40 | 0.15 |
| Comp. Ex. 4 | 7.27 | 45 | 0.12 |
| Comp. Ex. 5 | 7.3 | 30 | 0.1 |
| Comp. Ex. 6 | 7.15 | 80 | 0.2 |
| Comp. Ex. 7 | 7.25 | 30 | 0.1 |
| Comp. Ex. 8 | 7.25 | 40 | 0.1 |
| Comp. Ex. 9 | 7.02 | 50 | 0.15 |
| Comp. Ex. 10 | 7.27 | 25 | 0.1 |
| Comp. Ex. 11 | 7.1 | 60 | 0.2 |

Figure 2:
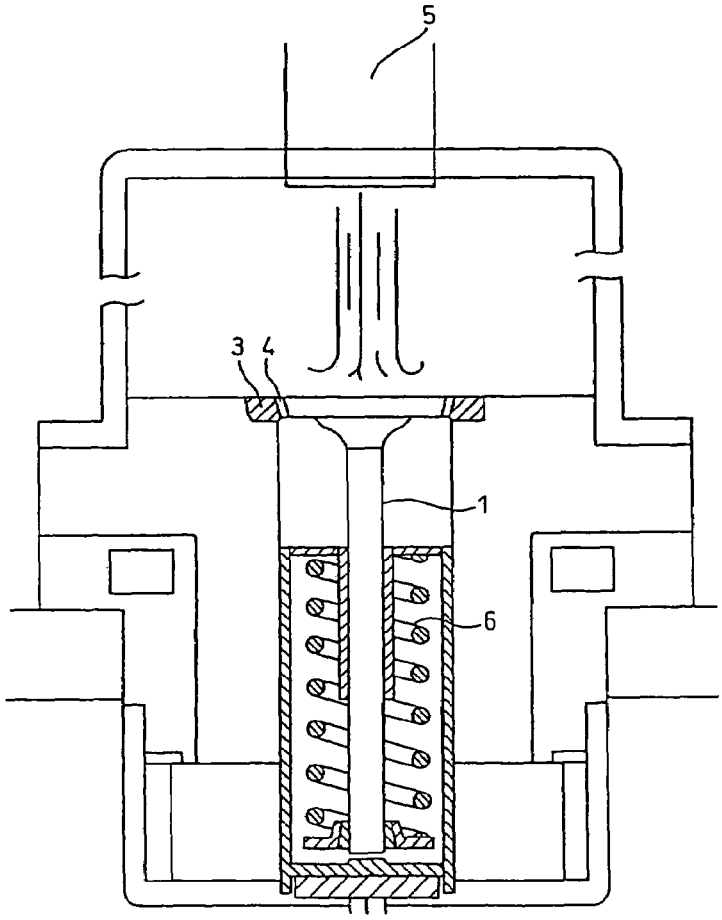
FIG. 2 is a cross sectional view of an apparatus in which a unit wear test is being conducted.

Thereafter, a wear resistance test was conducted on the sintered alloys using a tester shown in FIG. 2. During the test, a propane gas burner 5 was used as the source of heat, and a ring-shaped valve seat 3 as the test piece made of each of the sintered alloys manufactured as described above was used in combination with valve 1 made of SUH35 with a Mo—Co—Fe—Ni—Mn alloy (Mo 31%, Co 13%, Fe 10%, Ni 6%, Mn 5%, Cr 1%, $C_1$%, Si) laid on a face portion 4. The valve seat 3 was heated to 200° C. using the propane gas burner 5 as the heating source, and a load of 25 kgf was provided by a spring 6 upon contact between the valve seat 3 and the valve face 4. The valve seat 3 and the valve face 4 were brought into contact with one another at a rate of 2300 times per minute for 8 hours.

The resultant valve projection amount (μm) and seat contact width increase (mm) were measured and are shown in Table 5. The valve projection amount is the distance by which the valve position when the valve is opened or closed is displaced along the valve axis due to the wear in the valve seat 3 and valve face 4. The seat contact width increase is the amount by which the width of the valve seat 3 in contact with the valve face increased due to the wear in the valve seat as it comes into contact with the valve face 4.

As shown in FIG. 5, most of the sintered alloys according to Examples 1 to 11 of the present invention are denser than the comparative examples. The examples also show considerably lower valve projection amount (μm) and seat contact width increase (mm) than the comparative examples, thus indicating the superior wear resistance of the examples according to the invention. Comparative Example 7, which did not contain Mn in the hard particle powder, showed lower density than Examples 1, 8 and 9 containing varying amounts of Mn. Thus, it can be seen that Mn provides a density improving effect.

The wear resistance of the alloys according to the invention were further tested by mounting the valve seat of Example 1 and those of Comparative Examples 10 and 11 in which hard particles P and Q of conventional materials were mixed on an actual engine. The engine was fueled with CNG and had a piston displacement of 1500 cc. After 300 hours of endurance testing using the engine, the valve projection amount (mm) and the seat contact width increase (mm) on the exhaust side were measured in the same manner as described above. On the intake side, the valve face was made of SUH11, which was treated by nitrocarburization. On the exhaust side, the valve face was made of a layer of Mo-base alloy. The results of measurement are shown in Table 6. The valve projection amount is the amount by which the valve position when the valve is closed is displaced (projected) toward the outside of the engine due to the wear of the valve seat and valve face. The valve seat contact width increase is the amount by which the width of the valve seat in contact with the valve face increases due to the wear of the valve seat as it comes into contact with the valve face.

As will be seen from Table 6, both the valve projection amount and the seat contact width increase in Example 1 were greatly reduced as compared with either Comparative Example 10 or 11, indicating the superior wear resistance of Example 1. It will also be seen that the wear resistance of Example 1 is superior to Comparative Example 11 in which the compacting and sintering were repeated twice for improving density.

TABLE 6

| | Exhaust valve projection amount (mm) | Exhaust valve seat contact width increase (mm) |
|---|---|---|
| Ex. 1 | 0.06 | 0.25 |
| Comp. Ex. 10 | 0.13 | 0.5 |
| Comp. Ex. 11 | 0.14 | 0.55 |

From the above description, the following technical features of the present invention will be recognized:

(1) The hard particles do not contain Fe as an active element.

(2) The hard particles do not contain Ni as an active element.

(3) The hard particles do not contain Cr as an active element.

(4) The hard particles do not contain Si as an active element.

(5) The wear-resistant iron-base sintered alloy can be used not only in valve seats but also in engine valves in general.

Thus, in accordance with the invention, a sintered alloy with greatly improved wear resistance as compared with the conventional alloy and a valve seat made of the sintered alloy can be obtained. In particular, the valve seat according to the invention can be suitably used in gas engines such as those fueled by CNG (compressed natural gas) or LPG (liquefied petroleum gas).

What is claimed is:

1. A hard particle consisting of 20% to 70% Mo by mass, 0.2% to 3% C by mass, 1% to 15% Mn by mass, with the remainder being unavoidable impurities and Co.

2. A wear-resistant iron-base sintered alloy comprising:

a total component comprising, against the total of 100%, 4% to 35% Mo by mass, 0.2% to 3% C by mass, 0.5% to 8% Mn by mass, 3% to 40% Co by mass, with the remainder being unavoidable impurities and Fe;

a base material component comprising, against the total of 100%, 0.2% to 5% C by mass, 0.1% to 10% Mn by mass, with the remainder being unavoidable impurities and Fe; and a hard particle component consisting of, against the total of 100%, 20% to 70% Mo by mass, 0.2% to 3% C by mass, 1% to 15% Mn by mass, with the remainder being unavoidable impurities and Co, wherein the hard particles are dispersed in the base material in an areal ratio of 10% to 60%.

3. The wear-resistant iron-base sintered alloy according to claim 2, wherein a ratio $\alpha$ of the amount in percentage by mass of Mn in the base material of the sintered alloy to the amount in percentage by mass of Mn in the hard particles dispersed in the base material of the sintered alloy is within the range between 0.05 and 1.0.

4. The wear-resistant iron-base sintered alloy according to claims 2 or 3, wherein the alloy is used in a valve seat of a gas engine fueled by compressed natural gas or liquefied petroleum gas.

5. A method of manufacturing the wear-resistant iron-base sintered alloy according to claims 2 or 3 by preparing a mixed material of 10% to 60% a powder of the hard particle according to claim 1 by mass, 0.2% to 2% carbon powder by mass, with the remainder being a powder of pure Fe or low-alloy steel, molding the mixed material into a powder compact molded product, and sintering the powder compact molded product.

6. A valve seat formed by the wear-resistant iron-base sintered alloy according to claims 2 or 3.

* * * * *